US008424856B2

(12) United States Patent
Lombardi et al.

(10) Patent No.: US 8,424,856 B2
(45) Date of Patent: Apr. 23, 2013

(54) CLAMP WITH REMOVABLE JAW

(75) Inventors: Keith M. Lombardi, Avon, CT (US); Eric Ranieri, Besancon (FR)

(73) Assignee: Stanley Black & Decker, Inc., New Britain, CT (US)

( * ) Notice: Subject to any disclaimer, the term of this patent is extended or adjusted under 35 U.S.C. 154(b) by 1622 days.

(21) Appl. No.: 11/898,571

(22) Filed: Sep. 13, 2007

(65) Prior Publication Data

US 2009/0071298 A1 Mar. 19, 2009

(51) Int. Cl.

| | |
|---|---|
| ***B25B 1/00*** | (2006.01) |
| ***B25B 11/00*** | (2006.01) |
| ***B25B 1/20*** | (2006.01) |
| ***B25B 1/10*** | (2006.01) |
| ***B25B 5/10*** | (2006.01) |
| ***B25B 5/00*** | (2006.01) |
| *B25B 13/12* | (2006.01) |

(52) U.S. Cl.
USPC ..... 269/6; 369/3; 369/43; 369/249

(58) Field of Classification Search ..... 269/6, 3, 269/249, 43, 170, 171.5
See application file for complete search history.

(56) References Cited

U.S. PATENT DOCUMENTS

| | | | | |
|---|---|---|---|---|
| 1,638,848 | A | 8/1927 | Hargrave | |
| 4,926,722 | A | 5/1990 | Sorensen et al. | |
| 4,989,847 | A | 2/1991 | Chapman | |
| 5,009,134 | A | 4/1991 | Sorensen et al. | |
| 5,222,420 | A | 6/1993 | Sorensen et al. | |
| 5,443,246 | A | 8/1995 | Peterson | |
| 5,584,458 | A | 12/1996 | Rando | |
| 5,826,310 | A | 10/1998 | Hobday | |
| 6,338,475 | B1 | 1/2002 | Ping | |
| 6,338,478 | B2 | 1/2002 | Baculy | |
| 6,347,791 | B1 * | 2/2002 | Chervenak | 269/6 |
| 6,382,608 | B1 * | 5/2002 | Michell | 269/6 |
| 6,386,530 | B1 | 5/2002 | Marks | |
| 6,412,767 | B1 * | 7/2002 | Beckmann et al. | 269/166 |
| 6,575,442 | B2 | 6/2003 | Klimach et al. | |
| 6,669,353 | B2 | 12/2003 | Kung | |
| 6,746,006 | B2 | 6/2004 | Thomas | |
| 6,889,966 | B2 | 5/2005 | Wirth, Jr. et al. | |
| 6,896,248 | B1 * | 5/2005 | Andulics | 269/3 |
| 6,929,253 | B2 * | 8/2005 | Marks | 269/6 |

(Continued)

OTHER PUBLICATIONS

Extended Search Report as issued for European Patent Application No. 08163074.1, dated Jul. 21, 2010.

(Continued)

*Primary Examiner* — Lee D Wilson
*Assistant Examiner* — Alvin Grant
(74) *Attorney, Agent, or Firm* — Pillsbury Winthrop Shaw Pittman LLP

(57) ABSTRACT

A hand-actuated bar clamp apparatus is disclosed which provides a high level of holding power or force on a workpiece. The bar clamp includes first and second jaws that are movably coupled to a bar. The first jaw includes a drive lever that engages the bar and a trigger that drives the drive lever to move the bar relative to the first jaw. A brake mechanism is contained within the first jaw to prevent it from moving in the opposite direction. The second jaw includes a push-button release assembly and a stop mechanism actuated by the push-button release assembly. The stop mechanism frictionally engages the second jaw to the bar when the second jaw is not under load.

26 Claims, 12 Drawing Sheets

U.S. PATENT DOCUMENTS

| | | | | |
|---|---|---|---|---|
| 6,945,523 | B2 | 9/2005 | Degen | |
| 6,957,808 | B2 * | 10/2005 | Varzino et al. | 269/95 |
| 7,017,894 | B1 * | 3/2006 | Lin | 269/6 |
| 7,066,457 | B2 * | 6/2006 | Gerritsen et al. | 269/6 |
| 7,090,209 | B1 * | 8/2006 | Rowlay | 269/6 |
| 7,131,642 | B1 | 11/2006 | Rowlay et al. | |
| 7,159,858 | B2 | 1/2007 | Ben-Gigi | |
| 7,172,183 | B1 * | 2/2007 | Yang | 269/6 |
| 7,322,571 | B2 * | 1/2008 | Springer | 269/6 |
| 7,604,224 | B2 * | 10/2009 | Rowlay et al. | 269/6 |
| 7,624,974 | B2 * | 12/2009 | Zheng | 269/6 |
| 7,699,297 | B2 * | 4/2010 | Cicenas et al. | 269/6 |
| 7,815,175 | B2 * | 10/2010 | Cicenas et al. | 269/6 |
| 2006/0043660 | A1 | 3/2006 | Ping | |
| 2006/0091596 | A1 | 5/2006 | Marusiak | |
| 2006/0131802 | A1 | 6/2006 | Fuller et al. | |
| 2006/0290041 | A1 | 12/2006 | Hobday | |
| 2007/0069437 | A1 | 3/2007 | Rowlay et al. | |
| 2007/0069438 | A1 | 3/2007 | Rowlay et al. | |

OTHER PUBLICATIONS

Partial Search Report as issued for European Patent Application No. 08163074.1, dated Apr. 6, 2010.

* cited by examiner

CLAMP WITH REMOVABLE JAW

FIELD OF THE INVENTION

The present invention relates to the field of tools, and more particularly to an adjustable clamping device and method of using the same.

BACKGROUND OF THE INVENTION

A clamp is a device used to join, grip, support, or compress mechanical or structural parts. Clamps use opposing, often adjustable sides or parts for bracing objects or holding them together.

One type of clamp is an adjustable bar clamp. Adjustable bar clamps typically are made of three main components: a drive unit integral with a jaw, a bar that is advanced by the drive unit, and an opposing jaw that is connected to the bar. A workpiece is positioned between the clamps when the clamps are used to compress the workpiece. The clamps may also be positioned to function as a spreader. These clamps are typically hand-actuated and are known to exist in many varieties.

SUMMARY OF THE INVENTION

According to a first embodiment of the invention, a bar clamp is disclosed that includes a bar, a stop associated with the bar, and a first jaw movably coupled to the bar. The first jaw has a drive lever that engages the bar and a trigger that drives the drive lever to move the bar relative to the first jaw. The bar clamp also includes a second jaw movably coupled to the bar. The second jaw has an aperture to enable the second jaw to receive the bar and pass over the stop. The second jaw includes a release assembly having a stop mechanism and a manually engageable release member. The stop mechanism engages the bar to prevent or inhibit movement of the second jaw relative to the bar. Manual actuation of the release member facilitates movement of the second jaw relative to the bar. The release assembly is movable between a first orientation where it blocks a portion of the aperture, thereby preventing the jaw from moving past the stop and a second orientation wherein it enables the stop to pass through the aperture.

According to a second embodiment of the invention, a bar clamp is disclosed including a bar and a first jaw movably coupled to the bar. The first jaw has a drive lever that engages the bar and a trigger that drives the drive lever to move the bar relative to the first jaw. The bar clamp also includes a second jaw movably coupled to the bar. The second jaw has an aperture to enable the second jaw to receive the bar. The second jaw includes a stop mechanism which is spring biased into engagement with the bar to prevent free movement of the second jaw relative to the bar while allowing forced movement of the second jaw relative to the bar.

According to a third embodiment of the invention. a bar clamp is disclosed including a bar, a stop associated with the bar and a first jaw movably coupled to the bar. The first jaw has a drive lever that engages the bar and a trigger that drives the drive lever to move the bar relative to the first jaw. The bar clamp also includes a second jaw movably coupled to the bar. The second jaw has an aperture to enable the second jaw to receive the bar and pass over the stop. The second jaw includes a release assembly having a manually engageable release member. The release assembly is movable from a first position to a second position. In the first position, the release assembly is orientated such that the second jaw is unable to move past the stop. In the second position, the release assembly is orientated so that the second jaw is able to move past the stop. Actuation of the release member moves the release assembly from the first position to the second position.

DETAILED DESCRIPTION OF ILLUSTRATED EMBODIMENTS

While the invention has been shown and described with reference to a particular embodiment thereof, it will be understood to those skilled in the art, that various changes in form and details may be made therein without departing from the spirit and scope of the invention.

Figure 1:
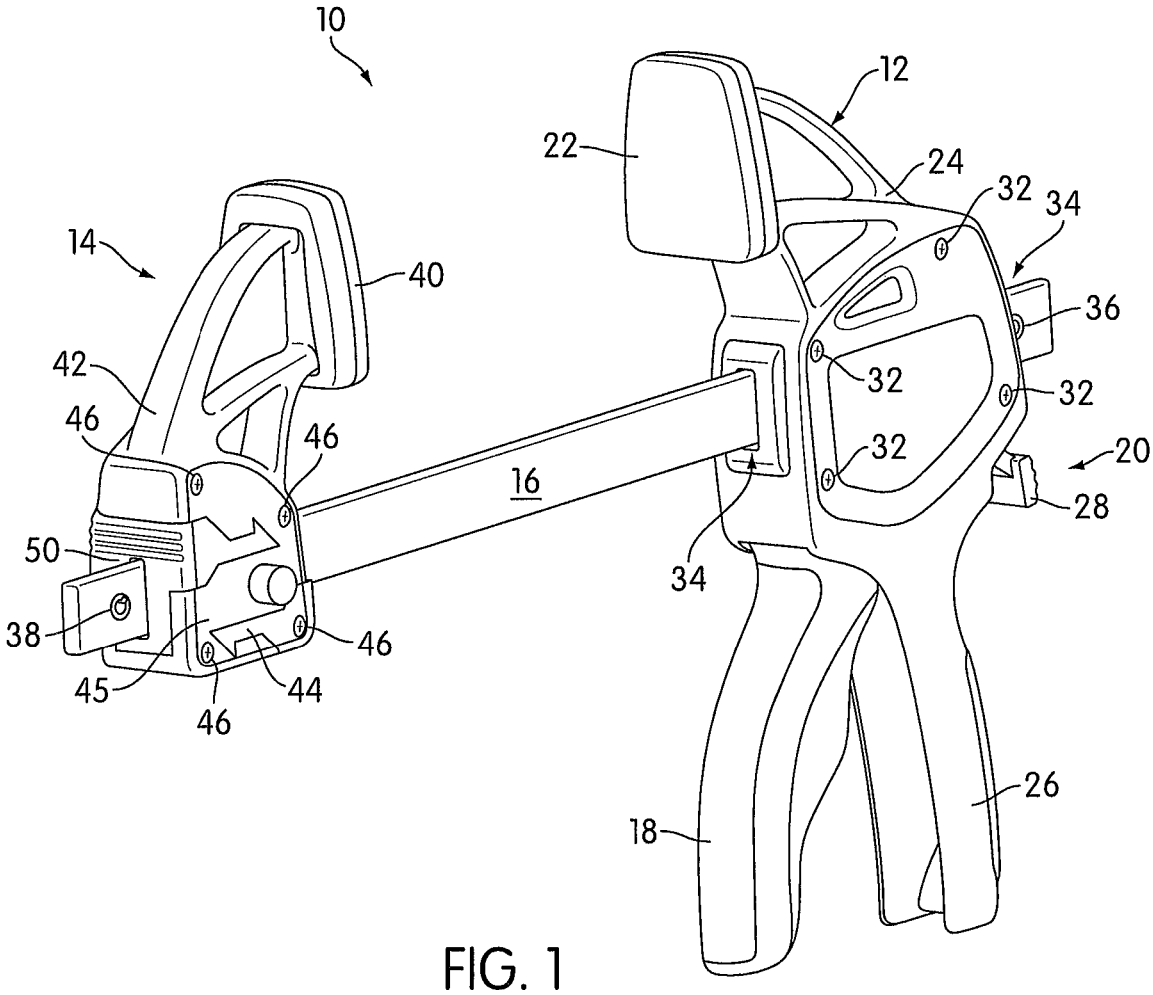
FIG. 1 illustrates a perspective view of an adjustable bar clamp in accordance with one embodiment of the invention.

FIG. 1 illustrates a perspective view of an adjustable bar clamp 10. Adjustable bar clamp 10 includes a first jaw 12 and a second jaw 14, each of which are movably coupled to a bar 16. The first jaw 12 includes a drive lever 68 (shown in FIG. 4) that engages bar 16 and a hand-operated trigger 18. Hand-operated trigger 18 actuates drive lever 68 in order to propel first jaw 12 toward second jaw 14. A brake mechanism 20 is contained within first jaw 12 to prevent it from moving in the opposite direction.

First jaw 12 includes a surface 22 for engaging a workpiece. In an exemplary non-limiting embodiment, surface 22 is formed of rubber that attaches to housing 24 of first jaw 12. It is desirable that surface 22 is formed from a material that has a high frictional surface for gripping a workpiece. In another exemplary non-limiting embodiment, this high friction surface may be formed from rubber coating a metal plate, or other rigid surface. Alternatively, this high friction surface could be created, in another embodiment, from patterning a metal, or other rigid surface without the use of a rubber coating. Housing 24 includes a handle 26 that opposes trigger 18. Together, handle 26 and trigger 18 provide a user with the ability to hold adjustable bar clamp 10 and actuate trigger 18 in order to operate drive lever 68 contained within housing 24, thereby moving first jaw 12 toward second jaw 14. A release button 28 extends from the rear of handle 26. Release button 28 actuates the breaking mechanism 20 contained within housing 24. This breaking mechanism 20 prevents the rearward movement of first jaw 12 when the breaking mechanism 20 is engaged with bar 16. Pushing release button 28 actuates the breaking mechanism 20 and disengages it from bar 16, thereby allowing first jaw 12 to move away from second jaw 14. An access panel 30 is attached to housing 24 by means of fasteners 32, which in this exemplary embodiment are Phillips head screws. Access panel 30 is provided to facilitate the fabrication and maintenance of first jaw 12 by allowing access to breaking mechanism 20 and drive lever 68 (shown in FIG. 4) contained within housing 24.

Trigger 18 and handle 26, in an exemplary embodiment, are ergonomically shaped to provide a comfortable hand-grip for the user. A user operates trigger 18 by squeezing trigger 18 toward handle 16.

Housing 24 includes a pair of apertures 34 through which bar 16 extends. Drive lever 68 and breaking mechanism 20 engage bar 16 within housing 24. Bar 16 includes positive stops 36 and 38 at each end of bar 16. Positive stops 36 and 38 prevent first jaw 12 and second jaw 14 from sliding off of bar 16. Positive stops 36 and 38 may be formed from screws, metal tubes or rods, posts, or other protrusions. In this non-limiting example, positive stops 36 and 38 are a metal tube.

Second jaw 14 is also provided with a surface 40 for engaging a workpiece. Like surface 22, in an exemplary non-limiting embodiment, surface 40 is formed of rubber that attaches to housing 42 of second jaw 14. It is desirable that surface 40 is formed from a material that has a high frictional surface for gripping a workpiece. In another exemplary non-limiting embodiment, this high friction surface may be formed from rubber coating a metal plate, or other rigid surface. Alternatively, this high friction surface could be created, in another embodiment, from patterning a metal, or other rigid surface without the use of a rubber coating.

Housing 42 includes a removable panel 44 that attaches with fasteners 46 to housing 42. Removable panel 44 provides access to a manually engageable release member, such as a spring-loaded push-button release assembly 48 (shown in FIG. 3) and stop mechanism 45 (shown in FIG. 3). Stop mechanism 45 frictionally secures second jaw 14 to bar 16 when second jaw 14 is not under load. Stop mechanism 45 is actuated by the push-button release member 48 protruding through panel 44. Together, stop mechanism 45 and push-button release assembly 48, also referred to as a manually engageable release member, form part of a release assembly 49. Apertures 50 in housing 42 allow for second jaw 14 to slide over bar 16.

Stop mechanism 45 contained in housing 40 blocks a portion of apertures 50, thereby preventing second jaw 14 from moving past protrusion 38. Depression of the push-button release assembly 48 moves stop mechanism 45, thereby unblocking apertures 50, allowing second jaw 14 to pass over protrusion 14. Stop mechanism 45 is biased into engagement with bar 16 to prevent free movement of second jaw 12 relative to bar 16 while allowing forced movement of second jaw 12 relative to bar 16.

In FIG. 1, first and second jaws 12 and 14 are positioned such that surfaces 22 and 40 face each other. In this configuration, first and second jaws 12 and 14 are configured to compress a workpiece between surfaces 22 and 40. First and second jaws 12 and 14 are moved toward each other by operation of trigger 18, which functions to actuate drive lever 68 within body 24, thereby applying a compressive force on the workpiece held between surfaces 22 and 40. Alternatively, first and second jaws 12 and 14 can be repositioned on bar 16 such that surfaces 22 and 40 face away from each other. In this configuration, adjustable bar clamp 10 functions as a spreader, whereby operation of drive lever 68 by trigger 18 within housing 24 causes jaws 12 and 14 to separate from each other placing a separating force on the workpiece.

Figure 2:
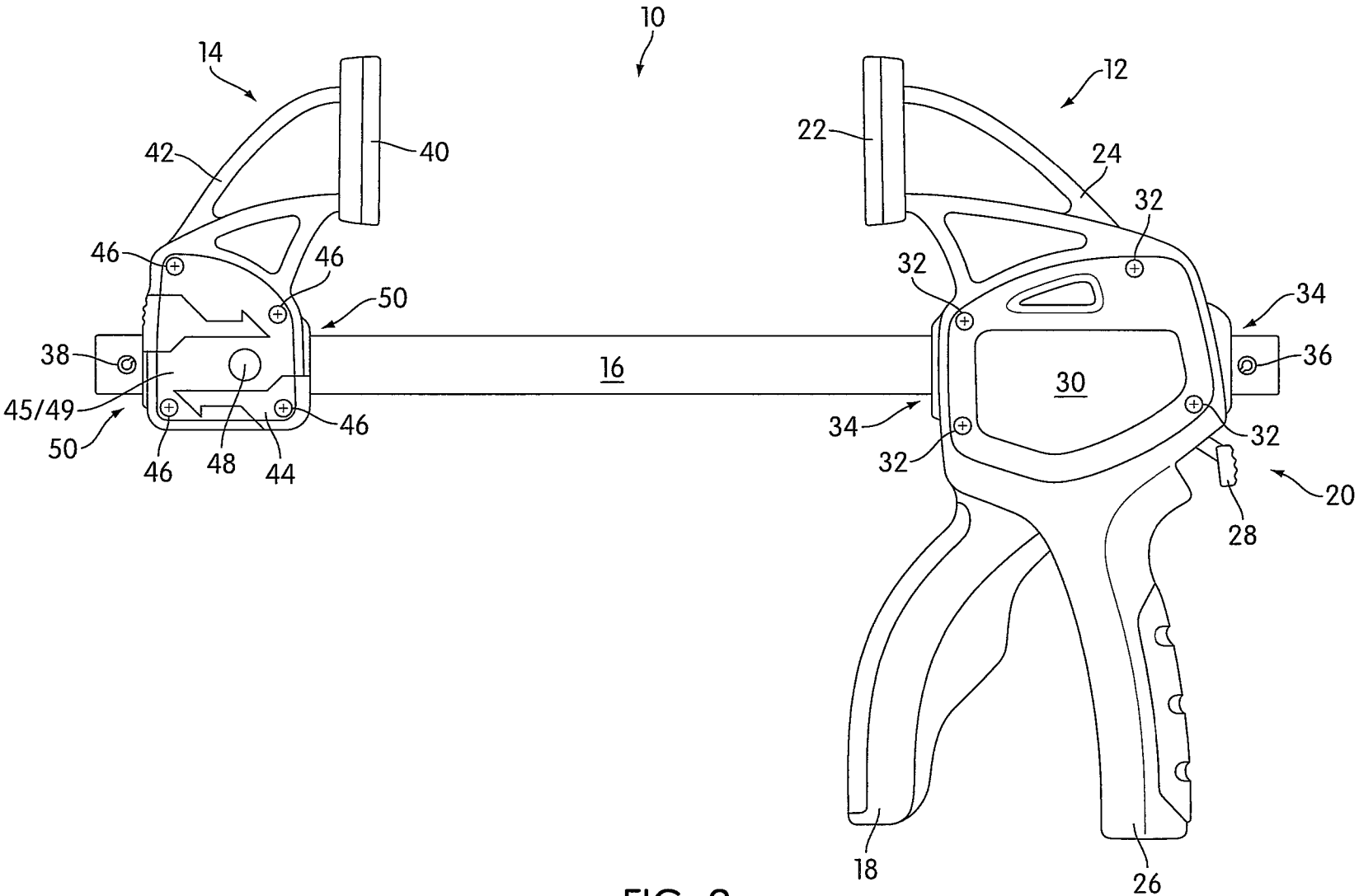
FIG. 2 illustrates a side view of an adjustable bar clamp in accordance with one embodiment of the invention.

FIG. 2 illustrates a side view of adjustable bar clamp 10. First jaw 12 is movable along the length of bar 16. First jaw 12 is prevented from sliding off of bar 16 by means of stop 36. Removal of stop 36 allows for the removal and repositioning of first jaw 12 on bar 16. First jaw 12 is advanced toward second jaw 14 by operation of trigger 18. Pulling trigger 18 toward handle 26 actuates drive lever 68 within housing 24 that advances first jaw 12 along bar 16. When trigger 18 is pivoted toward housing 24, drive lever 68 and plate 70 engage bar 16 and are held in a stationary position by friction with respect to bar 16. Pivoting trigger 18 with drive lever 68 and plate 70 held in a stationary position causes trigger 18 to pull housing 24 forward along bar 16. While housing 24 is pulled forward along bar 16 by trigger 18, spring 76 is compressed between plate 70 and wall 96. Thus, when trigger 18 is released after having pulled housing 24 forward, spring 76 pushes drive lever 68 and plate 70 forward along bar 16 to a new forward position. At this new forward position, the process of pulling trigger 18 and further advancing housing 24 can be repeated. The addition of plate 70 to drive lever 68 enhances the ability of drive lever 68 to frictionally engage bar 16 and be moved forward to a new forward position by spring 76. The inclusion of plate 70 reduces the chance that drive lever 68 would remain frictionally engaged to bar 16 after trigger 18 is released. First jaw 12 is prevented from moving away from second jaw 14 by brake mechanism 20 actuated by button 28. Brake mechanism 20 is biased to frictionally engage bar 16. When frictionally engaged, brake mechanism 20 allows for the advancement of first jaw 12 toward second jaw 14, but does not allow first jaw 12 to move away from second jaw 14. Release button 28 actuates brake mechanism 20, allowing it to be disengaged from bar 16 for first jaw 12 to move away from second jaw 14. Second jaw 14 is movable along bar 16. Operation of button 48 disengages stop mechanism 45, allowing second jaw 14 to move along the length of bar 16.

Figure 3:
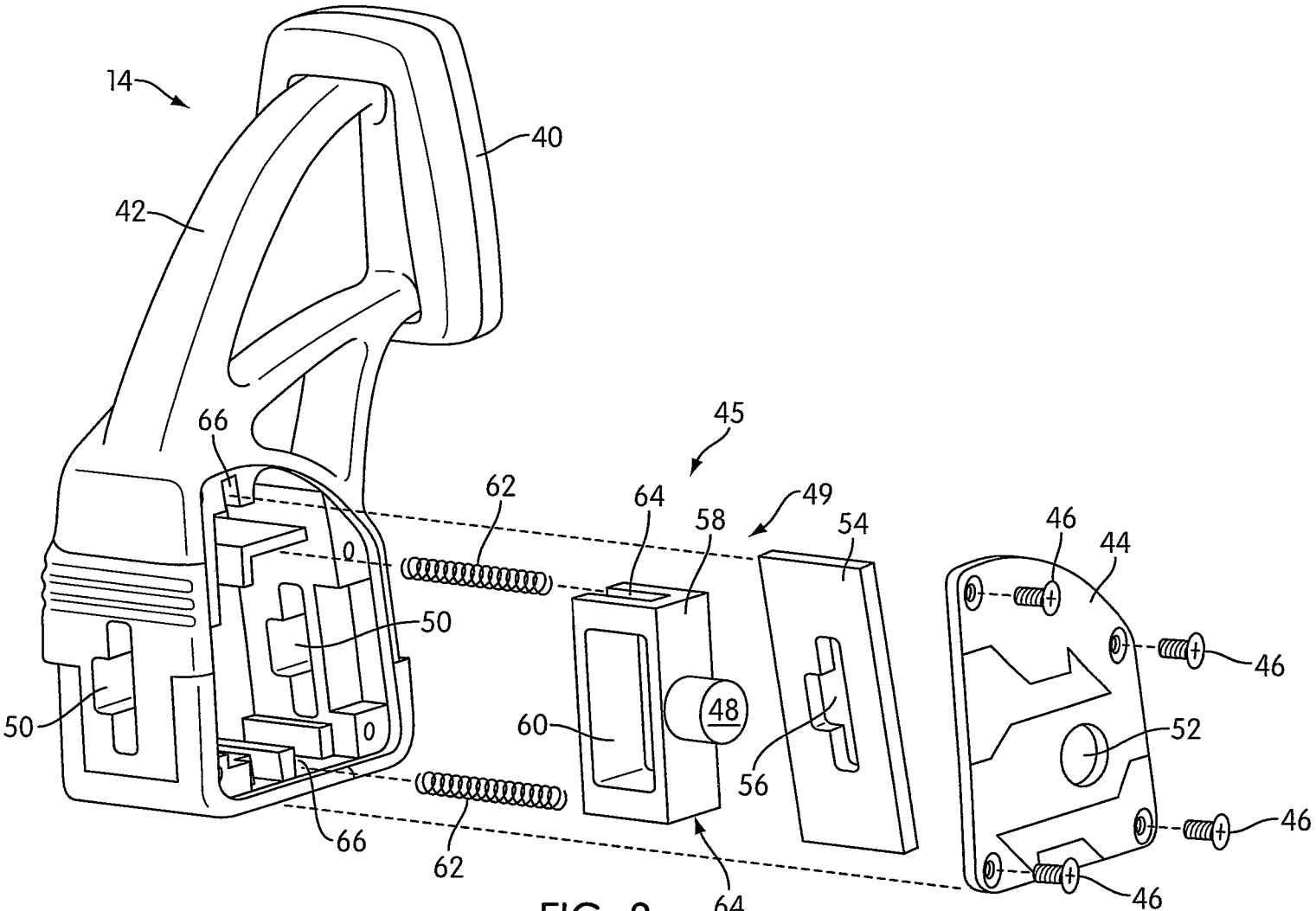
FIG. 3 illustrates an exploded view of a movable jaw having a stop mechanism in accordance with one embodiment of the invention.

FIG. 3 illustrates an exploded view of movable second jaw 14 having stop mechanism 45. Housing 42 includes removable panel 44 that is attached with screws 46. Button 48 that actuates stop mechanism 45 extends through hole 52 formed in removable panel 44 (see FIG. 7). A brake plate 54 is positioned at an angle within housing 42. Brake plate 54 includes a "T" shaped aperture 56 through which bar 16 extends. Bar 16 extends through apertures 50 formed in housing 42, which are also "T" shaped. Apertures 50 and 56 are "T" shaped to allow positive stop 50 to pass through second jaw 14. Brake plate 54 allows second jaw 14 to move along bar 16 when second jaw 14 is not under any load. However, when a load is placed against surface 40, second jaw 14 pivots (counter clockwise in FIG. 7) with respect to bar 16 causing brake plate 54 to frictionally engage bar 16, thereby holding second jaw 14 in a fixed position. The release assembly 49 includes the stop mechanism 45, push-button 48, frictional stop 58 having opening 60, and springs 62. Bar 16 extends through opening 60 in frictional stop 58. Springs 62 push frictional stop 58 against bar 16 to hold second jaw 14 in a stationary position on bar 16 when it is not under load (see FIG. 16). As second jaw 14 is movable along the length of bar 16, stop mechanism 45 prevents second jaw 14 from sliding freely along the length of bar 16. By pressing release button 48, frictional stop 58 is pushed away from bar 16 allowing second jaw 14 to move freely along bar 16 (see FIG. 17). Springs 62 are supported in housing 42 by slots 64 and 66 formed in frictional stop 58 and housing 42 respectively.

Figure 4:
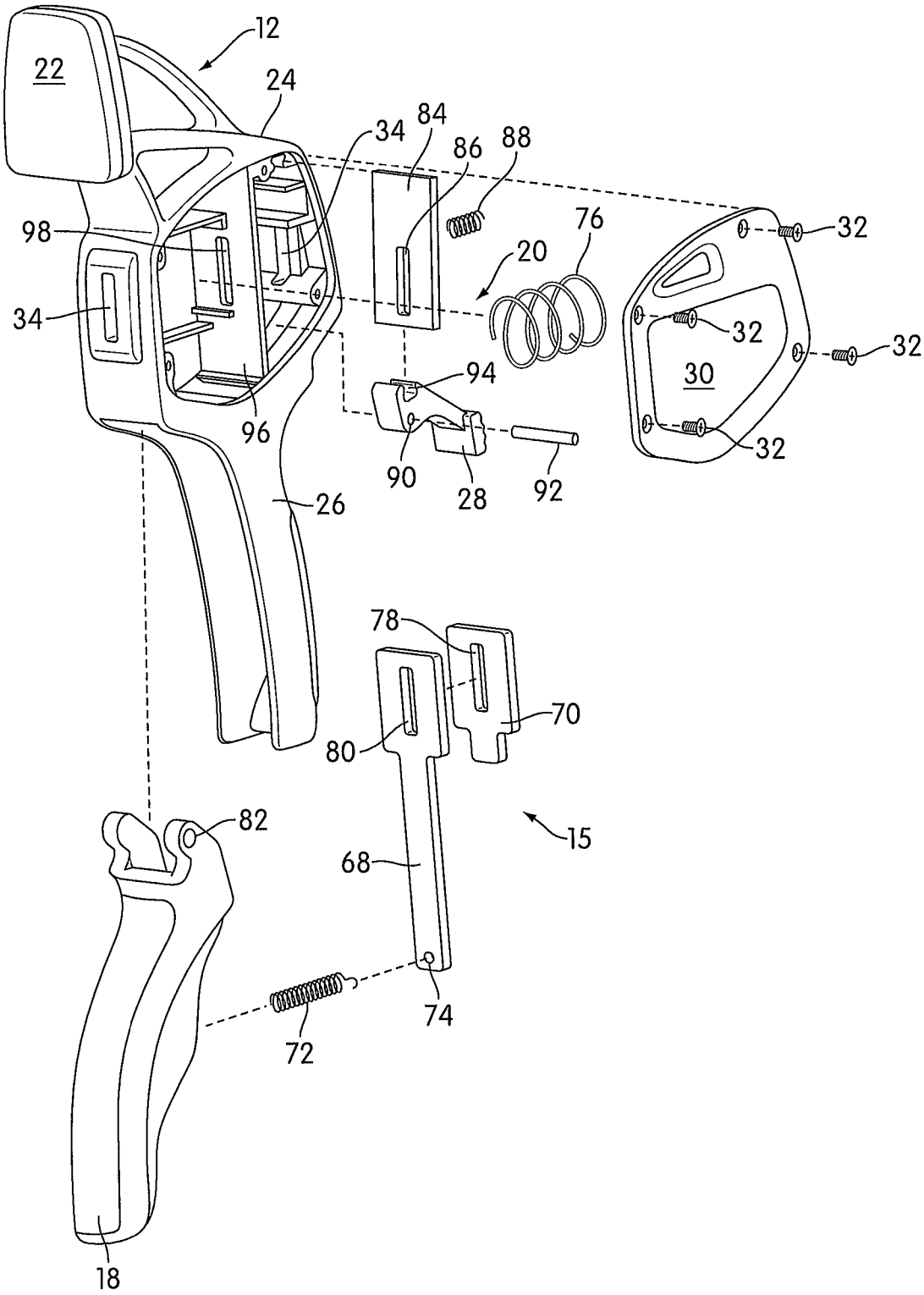
FIG. 4 illustrates an exploded view of a movable jaw having a brake mechanism in accordance with one embodiment of the invention.
Figure 7:
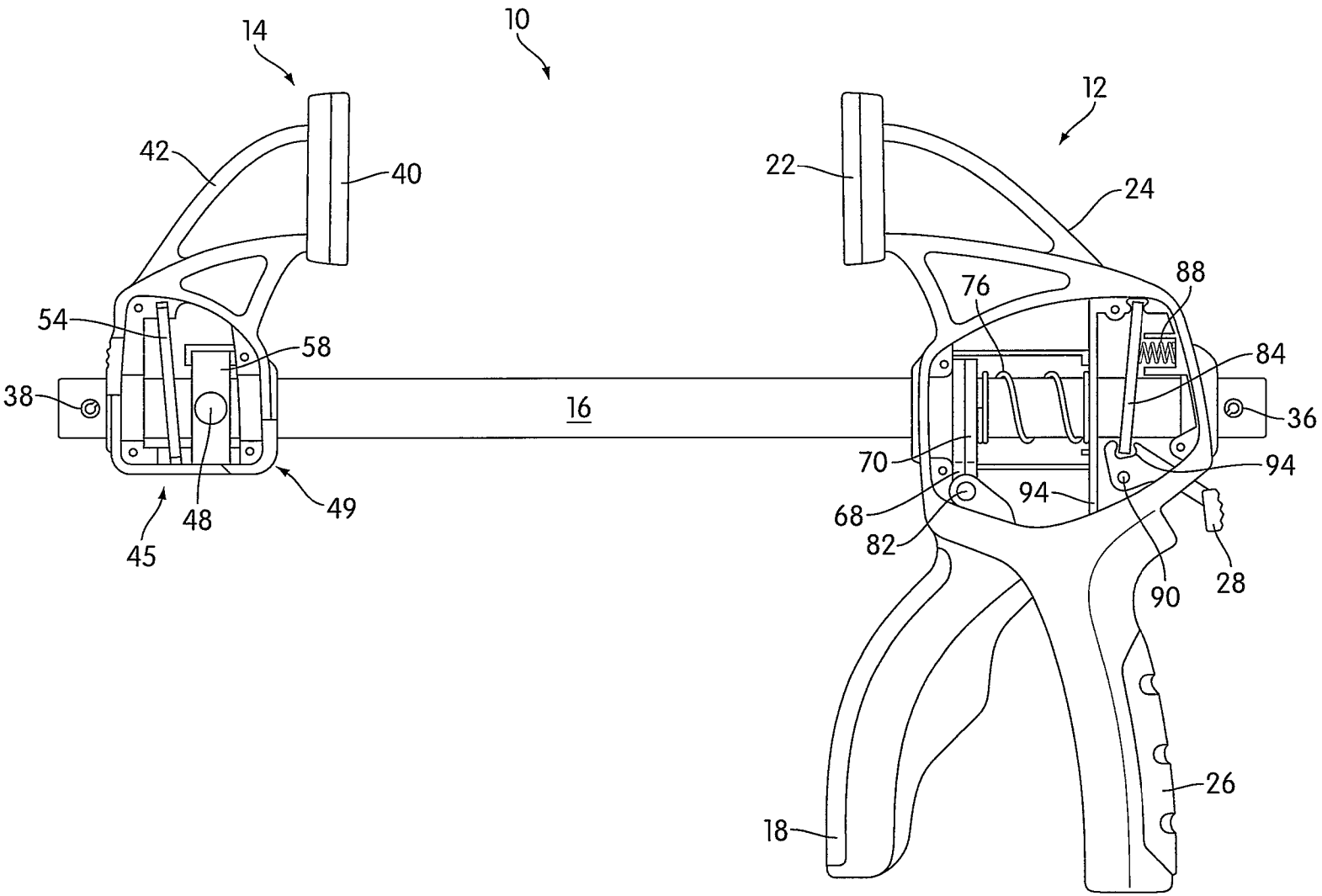
FIG. 7 illustrates a cutaway side view of an adjustable bar clamp showing the mechanisms of the movable jaws in accordance with one embodiment of the invention.

FIG. 4 illustrates an exploded view of movable first jaw 12 having a brake mechanism 20 (also see side view of FIG. 7). First jaw 12 includes drive lever 68 and plate 70 that are attached to trigger 18 by spring 72. First jaw 12 also includes spring 72 and spring 76. Spring 72 attaches to drive lever 68 at hole 74. Spring 76 places a force against drive lever 68 and plate 70. Apertures 78 and 80 are configured to receive bar 16. Trigger 18 is pivotally attached to housing 24 at pivot point 82. Pulling trigger 18 toward handle 26 causes housing 24 to move forward along bar 16. When trigger 18 is pivoted toward housing 24, drive lever 68 and plate 70 engage bar 16 and are held in a stationary position by friction with respect to bar 16. Pivoting trigger 18 with drive lever 68 and plate 70 held in a stationary position causes trigger 18 to pull housing 24 forward along bar 16. While housing 24 is pulled forward along bar 16 by trigger 18, spring 76 is compressed between plate 70 and wall 96. Thus, when trigger 18 is released after having pulled housing 24 forward, spring 76 pushes drive lever 68 and plate 70 forward along bar 16 to a new forward position. At this new forward position, the process of pulling trigger 18 and further advancing housing 24 can be repeated. The addition of plate 70 to drive lever 68 enhances the ability of drive lever 68 to frictionally engage bar 16 and be moved forward to a new forward position by spring 76. The inclusion of plate 70 reduces the chance that drive lever 68 would remain frictionally engaged to bar 16 after trigger 18 is released. Once trigger 18 has been pulled back fully against handle 26, releasing trigger 18 allows spring 76 to push plates 78 and 80 forward into a position where a further pulling of trigger 18 will advance first jaw 12.

Brake mechanism 20 includes button 28, brake plate 84 having aperture 86, and spring 88. Button 28 is pivotally mounted to housing 24 with hole 90 and rod 92. Spring 88 biases brake plate 84 into frictional engagement with bar 16. As such, brake plate 84 prevents the rearward movement of second jaw 12 along bar 16. Button 28 includes slot 94 that engages brake plate 84. Pressing button 28 pivots button 28 causing slot 94 to pull brake plate 84 backwards out of frictional engagement with bar 16, thereby allowing first jaw 12 to move backward along bar 16.

A wall 96 is provided within housing 24 that includes opening 98 for receiving bar 16. Wall 96 provides a support surface for spring 76 to exert force against when actuating plates 78 and 80.

Figure 5:
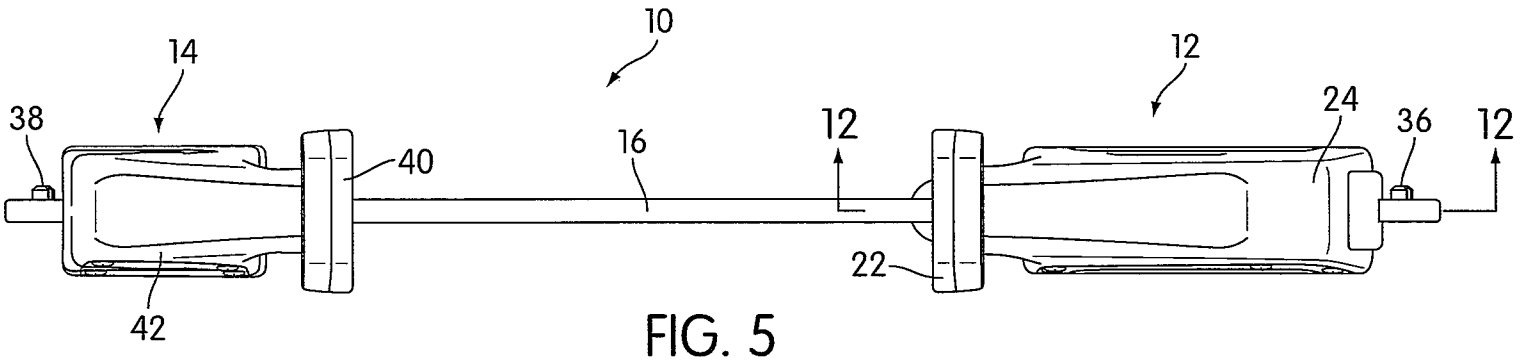
FIG. 5 illustrates a top view of an adjustable bar clamp in accordance with one embodiment of the invention.

FIG. 5 illustrates a top view of an adjustable bar clamp 10. Surfaces 40 and 22 face each other allowing them to grip and compress a workpiece. First jaw 12 is kept from sliding off bar 16 by positive stop 36. Second jaw 14 is kept from sliding off bar 16 by positive stop 38.

Figure 6:
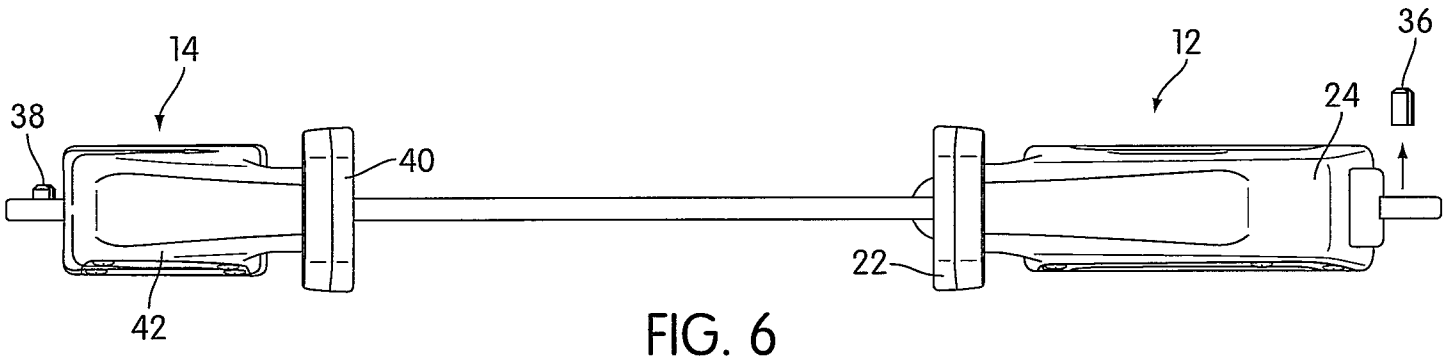
FIG. 6 illustrates a top view of an adjustable bar clamp having a positive stop removed in accordance with one embodiment of the invention.

FIG. 6 illustrates a top view of an adjustable bar clamp 10 having a positive stop 36 removed. With positive stop 36 removed, first jaw 12 is free to be removed from bar 16. For instance, first jaw 12 can be removed an positioned facing the opposite direction to enable adjustable bar clamp 10 to function as a spreader.

FIG. 7 illustrates a cutaway side view of an adjustable bar clamp 10 showing the mechanisms of first jaw 12 and second jaw 14. Frictional stop 58 coupled to button 48 are shown along with bar 16. Frictional stop extends around bar 16 to frictionally engage it and prevent second jaw 14 from moving with respect to bar 16. Brake plate 54 is shown positioned at an angle with respect to bar 16. Housing 42 holds brake plate 54 and frictional stop 58 in position with respect to second jaw 14 and bar 16. Pressing button 48 moves frictional stop 58 out of frictional engagement with bar 16, thereby allowing second jaw 14 to move along bar 16 freely.

First jaw 12 includes the trigger 18 that is coupled with drive lever 68 and plate 70. Pulling trigger 18 toward handle 26 pulls housing 24 toward second jaw 14 while drive lever 68 and plate 70 remain in a stationary position on bar 16 to which they are frictionally engaged. Releasing trigger 18 allows spring 76 to push out from wall 94 and advance drive lever 68 and plate 70 forward along bar 16, thereby allowing for additional advancement of housing 24 along bar 16 with a further pulling of trigger 18 against handle 26.

Brake plate 88 is positioned at an angle with respect to bar 16, thereby placing it into frictional engagement with bar 16. Spring 84 biases brake plate 84 and button 28 into a position where it frictionally engages bar 16. Pressing button 28 causes button 28 to pivot and compress spring 84. Pivoting button 28 causes brake plate 84 to become vertical, thereby disengaging it from frictional contact with bar 16, which can then move freely through first jaw 12.

Figure 9:
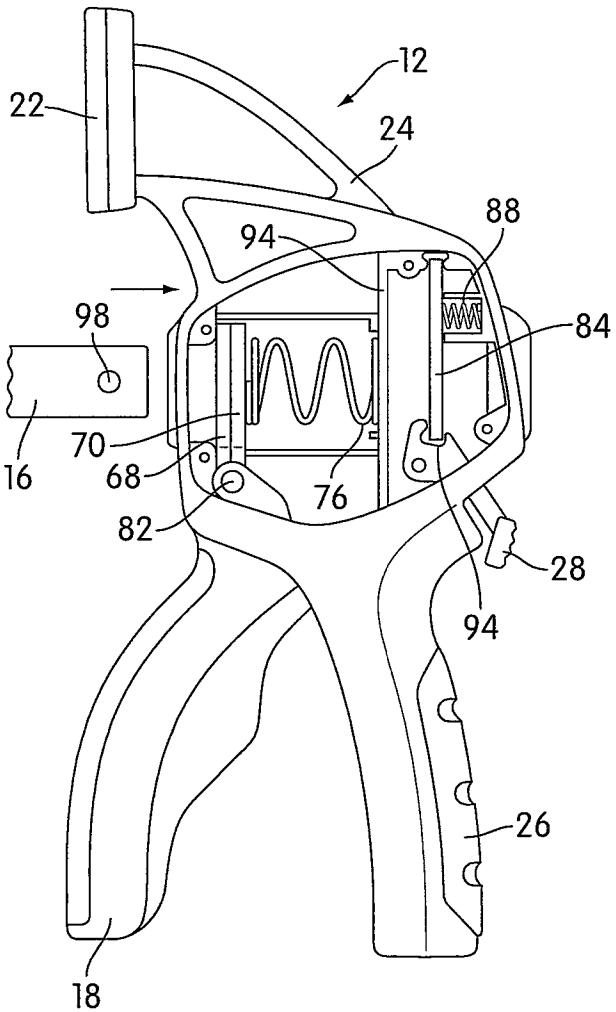
FIG. 8-11 depicts the operation of the bar in combination with the brake mechanism in accordance with one embodiment of the invention.
Figure 8:
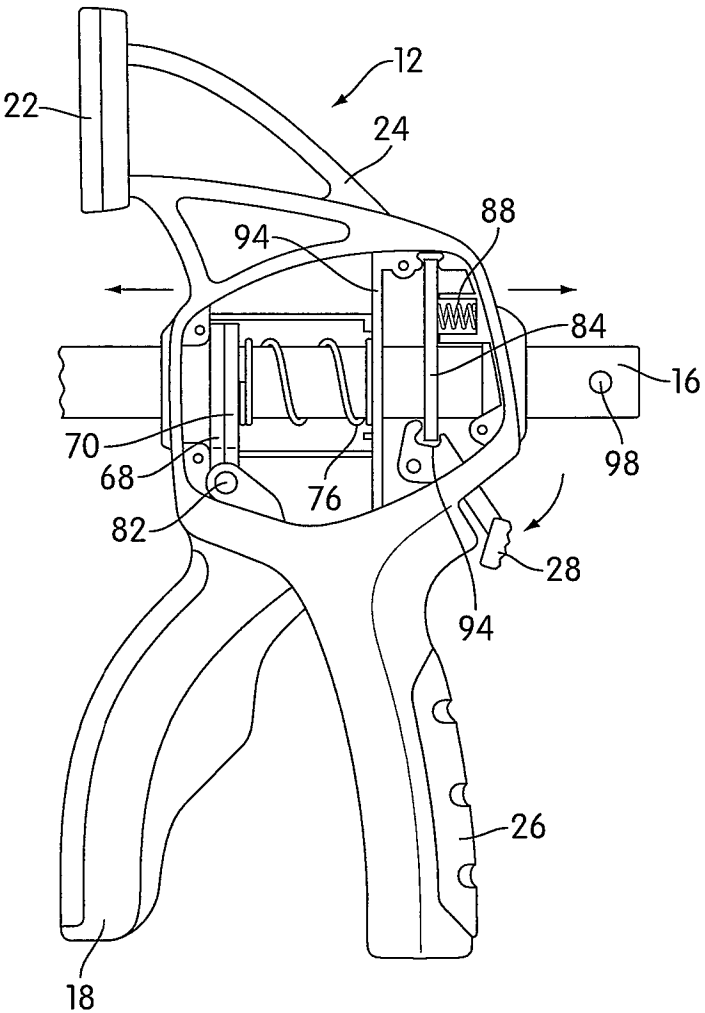
Figure 11:
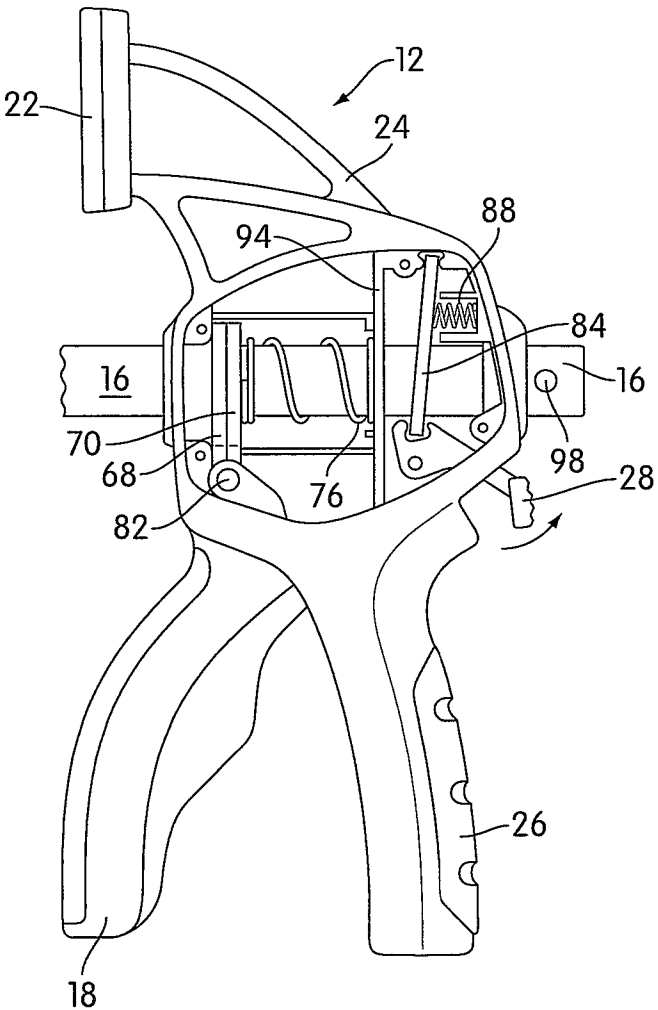
Figure 10:
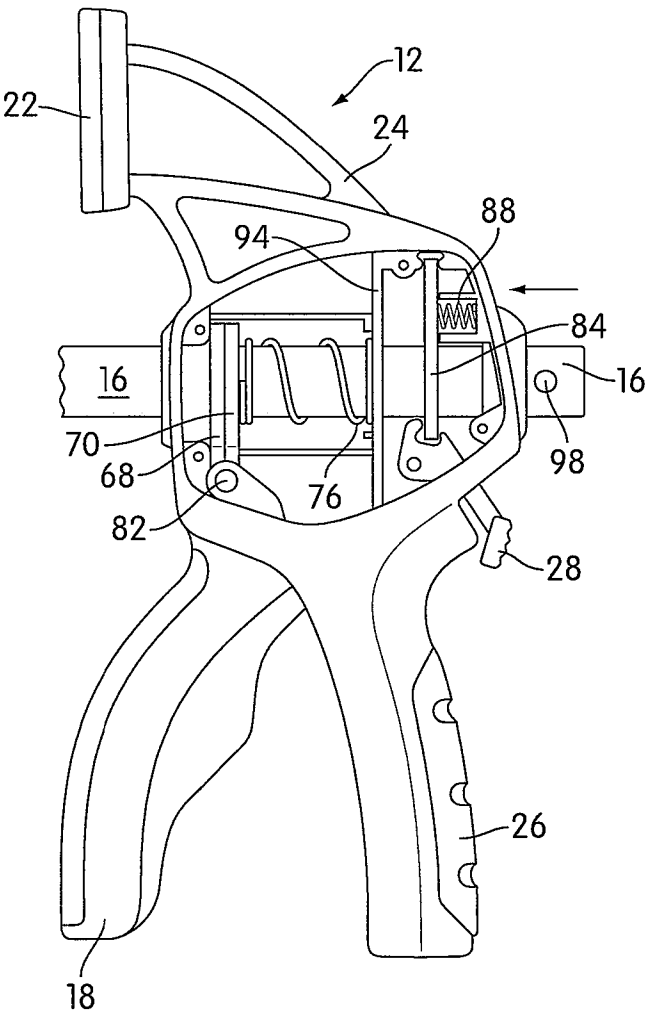

FIG. 8-11 depicts the operation of bar 16 in combination with brake mechanism 20. In FIG. 8, button 28 is pushed downward (as illustrated by the curved arrow adjacent button 28) causing slot 94 to pivot backward pulling brake plate 84 with it. Pulling brake plate 84 backward causes spring 88 to compress. Pushing button 28 causes brake plate 84 to change from an angled position to a vertical position with respect to bar 16. This change in position takes brake plate 84 out of frictional engagement with bar 16, thereby allowing bar 16 to move either direction with respect to second jaw 12 (as illustrated by the two opposing arrows above bar 16). FIG. 9 shows bar 16 completely removed from first jaw 12. An arrow adjacent bar 16 shows the direction of inserting bar 16 into first jaw 12. Note that in FIGS. 8 and 9, positive stop 36 is removed to allow for the disengagement of first jaw 12 from bar 16. FIG. 10 illustrates the forward movement of bar 16 with respect to first jaw 12 as indicated by the arrow above bar 16. FIG. 11 shows the release of button 28, which thereby allows spring 88 to bias brake plate 84 against bar 16, thereby holding it in frictional engagement against first jaw 12. The curved arrow adjacent button 28 shows the pivotal motion of button 28 when it is released.

Figure 13:
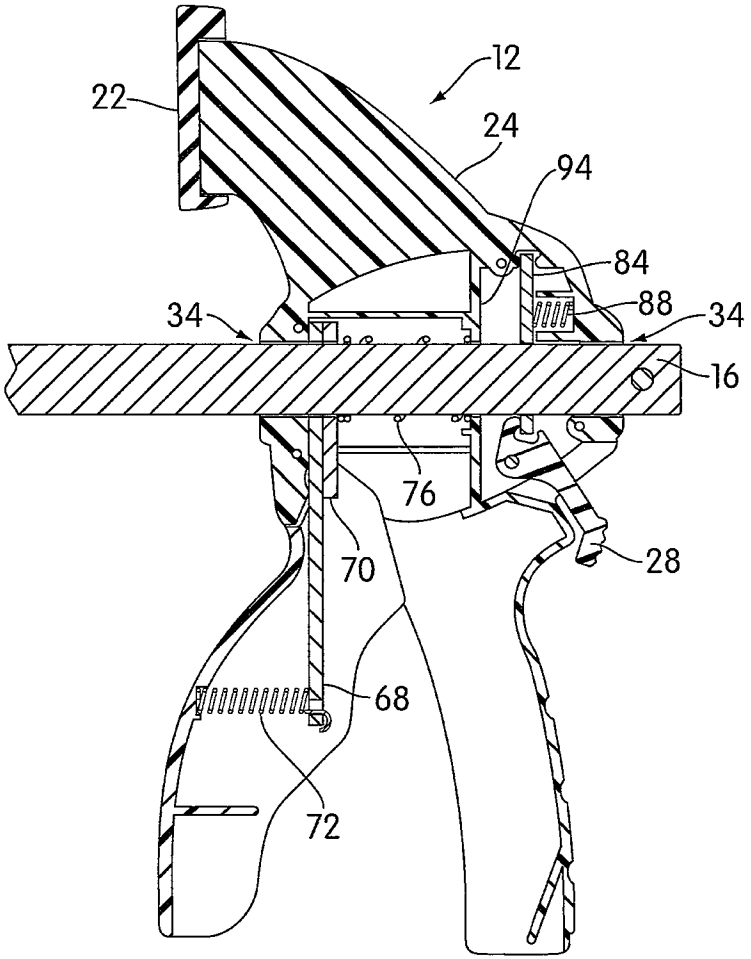
FIGS. 12 and 13 illustrates a sectional view of a jaw having a break mechanism in accordance with one embodiment of the invention.
Figure 12:
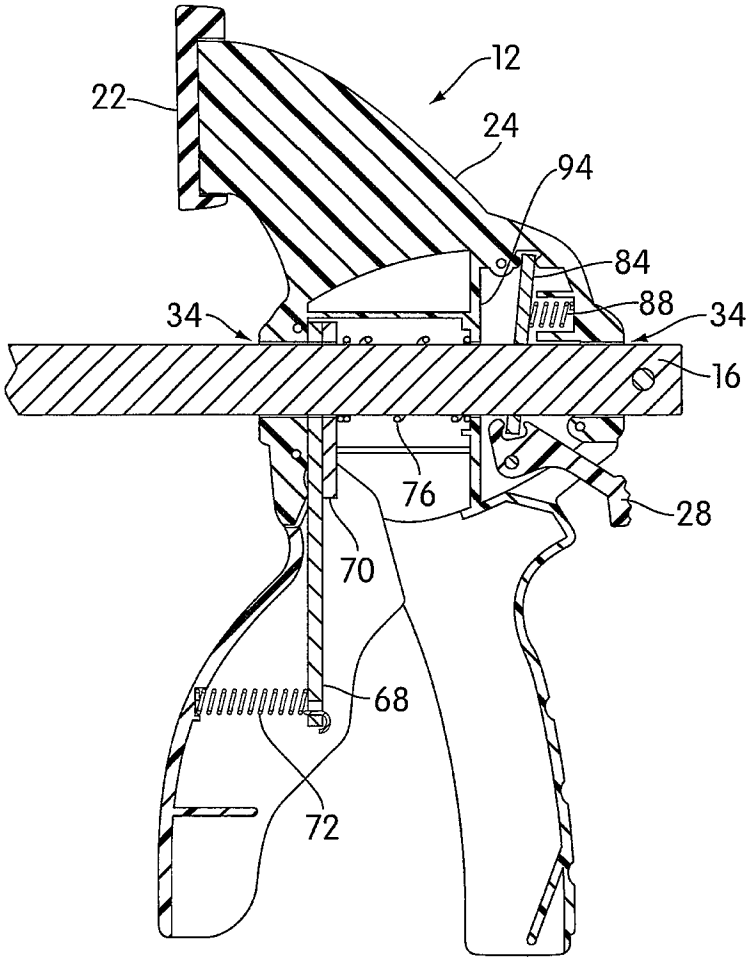

FIGS. 12 and 13 illustrates a sectional view of first jaw 12 having a break mechanism 20. Surface 22 is typically formed of rubber in an exemplary embodiment. Surface 22 may be formed from other plastics or metals in other exemplary embodiments. Housing 24 is formed typically from a high strength polymer in an exemplary embodiment. Bar 16, in an exemplary embodiment, is made from steel. Drive lever 68 and plate 70, wall 94, and brake 84 all have apertures for receiving bar 16. FIG. 12 shows brake plate 84 in frictional engagement with bar 16. FIG. 13 shows brake plate 84 out of frictional engagement with bar 16, where it is in a vertical position.

Figure 14:
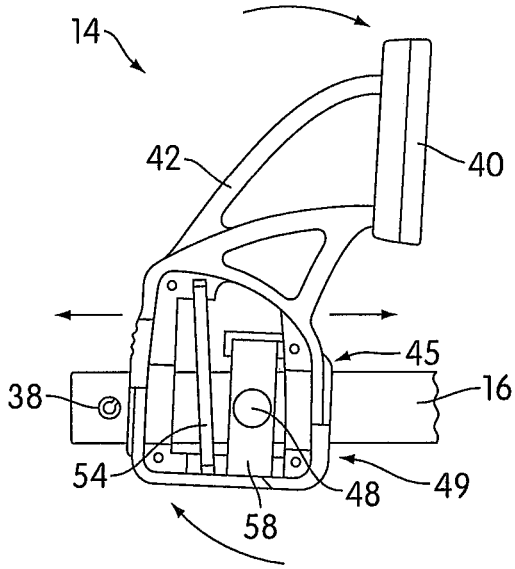
FIGS. 14 and 15 illustrate a cutaway view of a movable jaw having a stop mechanism in accordance with one embodiment of the invention.
Figure 15:
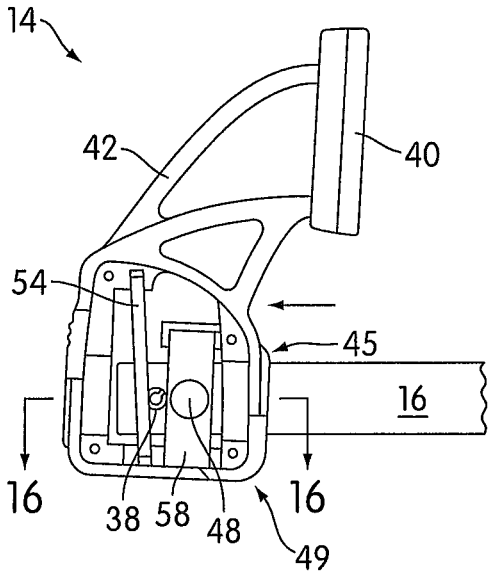

FIGS. 14 and 15 illustrate a cutaway view of movable second jaw 12 having stop mechanism 45. FIG. 14 shows the possible motions of second jaw 14 with respect to bar 16. In addition to moving along bar 16 is illustrated by the arrows above bar 16, second jaw 14 may pivot about bar 16. This pivotal motion is enabled by the fact that the apertures formed in housing 42, brake plate 54, and opening 60 in frictional stop 58 are larger than bar 16. When second jaw 14 is under load, second jaw 14 pivots counter-clockwise placing brake plate 54 into frictional engagement with bar 16. Similarly, when not under load, second jaw 14 may pivot clockwise such that brake plate 54 is not in frictional engagement with bar 16. FIG. 15 shows how second jaw 14 is kept on bar 16 by frictional stop 58. In this Figure, positive stop 38 has passed through into housing 42 where it is in direct contact with frictional stop 58, which blocks further movement of second jaw 14 with respect to bar 16. By pressing button 48 and disengaging frictional stop 58 from bar 16, it is possible to pass second jaw 14 all the way over positive stop 38 and remove it from bar 16.

Figure 16:
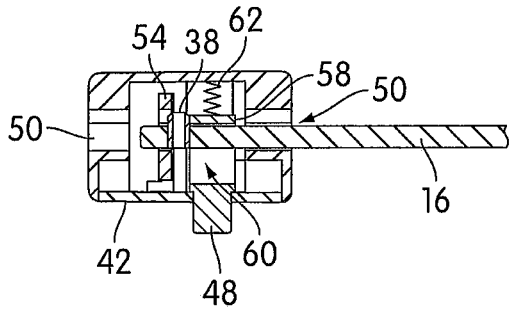
FIGS. 16-20 illustrates a sectional top view of a movable jaw having a stop mechanism in accordance with one embodiment of the invention.
Figure 17:
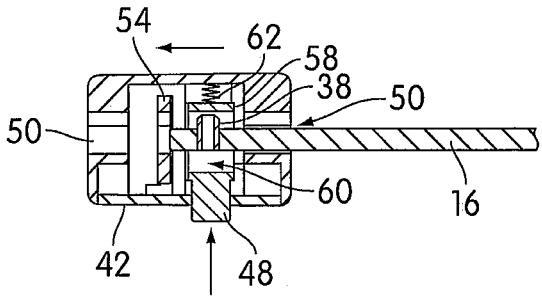
Figure 18:
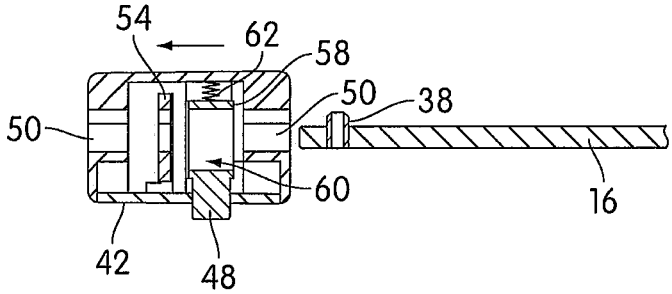
Figure 19:
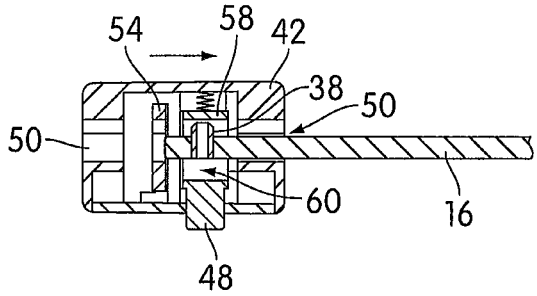
Figure 20:
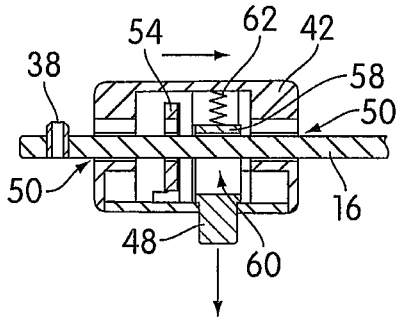

FIGS. 16-20 illustrates a sectional top view of a movable second jaw 14 having stop mechanism 45. FIG. 16 shows bar 16 passing partially through housing 42. Positive stop 38 abuts frictional stop 58 preventing further movement of bar 16 with respect to housing 42. Spring 62 pushes frictional stop 58 into frictional engagement with bar 16, holding bar 16 in a fixed position with respect to second jaw 14 and blocking further movement of positive stop 38. FIG. 17 illustrates the pushing of button 48 with an arrow. The pushing of button 48 presses frictional stop 58 against housing 42 and compresses spring 62. Thus, bar 16 and positive stop 38 are able to pass through opening 60 formed in frictional stop 58. FIG. 18 shows the complete removal of bar 16 from second jaw 14. FIGS. 19 and 20 show the process of putting second jaw 14 back on bar 16. In FIG. 19, button 48 is pressed in order to move frictional stop 58 into a position where positive stop 38 can slide through opening 60. FIG. 20 shows that bar 16 has passed completed through housing 42 and that spring 60 has biased frictional stop 58 against bar 16, thereby frictionally holding it in relative position with respect to housing 42.

While the invention has been shown and described with reference to a particular embodiment thereof, it will be understood to those skilled in the art, that various changes in form and details may be made therein without departing from the spirit and scope of the invention.

The invention claimed is:

1. A bar clamp, comprising:

a bar;

a stop associated with the bar;

a first jaw movably coupled to the bar, the first jaw having a drive lever that engages the bar and a trigger that drives the drive lever to move the bar relative to the first jaw;

a second jaw being movably coupled to the bar, the second jaw having an aperture to enable the second jaw to receive the bar and pass over the stop, the second jaw comprising:

a release assembly including a stop mechanism and a manually engageable release member, wherein the stop mechanism engages the bar to prevent or inhibit movement of the second jaw relative to the bar, and wherein manual actuation of the release member facilitates movement of the second jaw relative to the bar, the release assembly being movable between a first orientation wherein it blocks a portion of the aperture thereby preventing the jaw from moving past the stop and a second orientation wherein it enables the stop to pass through the aperture, wherein the stop mechanism is movable from a (i) first position wherein it (a) frictionally engages the bar and (b) blocks a portion of the aperture to prevent the second jaw from moving past the stop, and (ii) a second position wherein it (a) does not frictionally engage the bar and (b) does not block the aperture, thereby allowing the second jaw to move past the stop, and wherein the stop mechanism is movable between the (i) first position wherein it blocks a portion of the aperture through which the stop must pass for the second jaw to move past the stop, and (ii) the second position wherein the stop mechanism does not block the portion of the aperture through which the stop must pass for the second jaw to move past the stop, thereby allowing the second jaw to move past the stop.

2. The bar clamp of claim 1, further comprising a spring-loaded button that extends from the second jaw and spring-biases the release assembly toward its first orientation and spring biases the stop mechanism toward its first position.

3. The bar clamp of claim 1, wherein actuating the release member moves the stop mechanism, thereby unblocking the aperture, allowing the second jaw to pass over the stop.

4. The bar clamp of claim 1, the second jaw further comprising a plate having an aperture therein, wherein the plate lockingly engages the bar when force is applied to the second jaw.

5. The bar clamp of claim 4, wherein the aperture has a "T" shape.

6. The bar clamp of claim 4, wherein the plate is positioned orthogonally in one direction to the bar.

7. The bar clamp of claim 1, wherein the stop mechanism is biased into engaging the bar.

8. The bar clamp of claim 7, the stop mechanism comprising a pressure mechanism that extends around the bar.

9. The bar clamp of claim 8, wherein the pressure mechanism includes first and second springs.

10. The bar clamp of claim 9, wherein the pressure mechanism comprising a flat surface for frictionally engaging the bar.

11. The bar clamp of claim 1, wherein:

when the release assembly is in the first orientation, the release assembly blocks the portion of the aperture through which the stop must pass for the second jaw to move past the stop, and when the release assembly is in the first orientation, the release assembly prevents the stop from passing through the aperture.

12. The bar clamp of claim 1, wherein the stop protrudes outwardly from the bar and is fixed to the bar such that the stop moves with the bar relative to the first and second jaws.

13. A bar clamp, comprising:

a bar;

a first jaw movably coupled to the bar, the first jaw having a drive lever that engages the bar and a trigger that drives the drive lever to move the bar relative to the first jaw;

a second jaw being movably coupled to the bar, the second jaw having an aperture to enable the second jaw to receive the bar, the second jaw comprising:

a stop mechanism which is spring biased into engagement with the bar such that when the stop mechanism engages the bar under the spring bias, the stop mechanism prevents free movement of the second jaw relative to the bar while allowing forced movement of the second jaw relative to the bar in either direction of the bar, wherein the second jaw includes a clamping surface, wherein when a load is placed against the clamping surface, the second jaw pivots relative to the bar to hold the second jaw in a fixed position.

14. The bar clamp of claim 13, wherein:

the second jaw further comprises a clamping surface, and a brake that engages the bar when a force is applied to the clamping surface, thereby preventing forced sliding movement of the second jaw relative to the bar in a direction of the bar that is opposite to the clamping surface of the second jaw.

15. The bar clamp of claim 14, the brake comprising a plate having an aperture formed therein to receive the bar.

16. The bar clamp of claim 13, wherein the stop mechanism blocks a portion of the aperture when in spring biased engagement with the bar, thereby blocking the second jaw from passing over a stop that protrudes outwardly from the bar and is fixed to the bar such that the stop moves with the bar relative to the first and second jaws.

17. The bar clamp of claim 13, further comprising a release member that can be operated to release the stop mechanism from the spring biased engagement with the bar.

18. The bar clamp of claim 13, wherein a stop is associated with the bar and engages a portion of the stop mechanism that blocks a portion of the aperture, wherein the blocked portion of the aperture may be unblocked by moving the stop mechanism out of spring biased engagement with the bar.

19. The bar clamp of claim 13, wherein the aperture is "T" shaped.

20. The bar clamp of claim 13, wherein the stop mechanism is positioned to engage a stop associated with the bar to prevent the second jaw from being removed from the bar, the clamp further comprising a manually engageable release member that can be actuated to release the stop mechanism from its engagement with the bar and move the stop mechanism to a position that enables the second jaw to be removed from the bar.

21. A bar clamp, comprising:

a bar;

a stop associated with the bar;

a first jaw movably coupled to the bar, the first jaw having a drive lever that engages the bar and a trigger that drives the drive lever to move the bar relative to the first jaw;

a second jaw being movably coupled to the bar, the second jaw having an aperture to enable the second jaw to receive the bar and pass over the stop, the second jaw comprising:

a release assembly including a manually engageable release member, wherein the release assembly is movable from a first position to a second position, wherein in the first position the release assembly is orientated such that the second jaw is unable to move past the stop, and wherein in the second position the release assembly is orientated so that the second jaw is able to move past the stop, wherein actuation of the release member moves the release assembly from the first position to the second position wherein the release assembly includes a stop mechanism that is movable from a first position orientated to engage the stop, and a second position orientated to be out of the way of the stop, and wherein the stop mechanism frictionally engages the bar when in the first position.

22. The bar clamp of claim 21, wherein the release member comprises a spring-loaded button that extends from the second jaw.

23. The bar clamp of claim 21, the second jaw further comprising a plate having an aperture therein, wherein the plate lockingly engages the bar when force is applied to the second jaw.

24. The bar clamp of claim 23, wherein the plate is positioned orthogonally in one direction to the bar.

25. The bar clamp of claim 21, wherein the stop mechanism is slideable along the bar in both directions of the bar when it frictionally engages the bar.

26. A bar clamp comprising:

a bar;

a stop associated with the bar;

a first jaw movably coupled to the bar, the first iaw having a drive lever that engages the bar and a trigger that drives the drive lever to move the bar relative to the first jaw;

a second jaw being movably coupled to the bar, the second iaw having an aperture to enable the second jaw to receive the bar and pass over the stop, the second jaw comprising:

a release assembly including a stop mechanism and a manually engageable release member, wherein the stop mechanism engages the bar to prevent or inhibit movement of the second jaw relative to the bar, and wherein manual actuation of the release member facilitates movement of the second jaw relative to the bar, the release assembly being movable between a first orientation wherein it blocks a portion of the aperture thereby preventing the jaw from moving past the stop and a second orientation wherein it enables the stop to pass through the aperture, wherein the stop mechanism is movable from a (i) first position wherein it (a) frictionally engages the bar and (b) blocks a portion of the aperture to prevent the second jaw from moving past the stop, and (ii) a second position wherein it (a) does not frictionally engage the bar and (b) does not block the aperture, thereby allowing the second jaw to move past the stop, and wherein the stop mechanism is movable from a (iii) third position where it (a) does not frictionally engage the bar and (b) blocks a portion of the aperture to prevent the second jaw from moving past the stop.

* * * * *